US011168924B2

(12) United States Patent
Naicker et al.

(10) Patent No.: US 11,168,924 B2
(45) Date of Patent: Nov. 9, 2021

(54) HEATER

(71) Applicant: Dyson Technology Limited, Wiltshire (GB)

(72) Inventors: Lolan Naicker, Gloucester (GB); Ilidio Silvestre Guerreiro, Bath (GB)

(73) Assignee: Dyson Technology Limited, Malmesbury (GB)

( * ) Notice: Subject to any disclaimer, the term of this patent is extended or adjusted under 35 U.S.C. 154(b) by 245 days.

(21) Appl. No.: 15/974,435

(22) Filed: May 8, 2018

(65) Prior Publication Data

US 2018/0328624 A1 Nov. 15, 2018

(30) Foreign Application Priority Data

May 10, 2017 (GB) ..... 1707513

(51) Int. Cl.

| | |
|---|---|
| ***F24H 9/18*** | (2006.01) |
| ***H05B 3/50*** | (2006.01) |
| ***A45D 20/12*** | (2006.01) |
| ***F24H 3/04*** | (2006.01) |

(52) U.S. Cl.

CPC ..... *F24H 9/1872* (2013.01); *A45D 20/12* (2013.01); *F24H 3/0423* (2013.01); *H05B 3/50* (2013.01); *A45D 2200/155* (2013.01)

(58) Field of Classification Search

None

See application file for complete search history.

(56) References Cited

U.S. PATENT DOCUMENTS 1,755,790 A * 4/1930 Nevel ..... F24H 9/0052 126/118
2,261,136 A * 11/1941 Brown, Jr. ..... B21C 37/225 165/183
2,261,137 A * 11/1941 Brown, Jr. ..... F28F 1/20 165/183
2,298,250 A * 10/1942 Brown, Jr. ..... B23K 11/0046 219/107
2,578,305 A * 12/1951 Huet ..... F28F 13/06 165/164
2,644,225 A * 7/1953 Dietz ..... B21D 53/02 29/890.03

(Continued)

FOREIGN PATENT DOCUMENTS

CN 1152371 A 6/1997
CN 2314542 4/1999

(Continued)

OTHER PUBLICATIONS

Evaluation Report mailed Feb. 5, 2019, directed to CN Application No. 2018206919738; 7 pages.

(Continued)

*Primary Examiner* — Thor S Campbell

(74) *Attorney, Agent, or Firm* — Faegre Drinker Biddle & Reath LLP

(57) ABSTRACT

A heater comprising a ceramic heater element and at least two fins for dissipating heat from the ceramic heater element, wherein the ceramic heater element extends along a plane in one dimension and the at least two fins extend away from the plane, and wherein the at least two fins are connected to the ceramic heater element via discrete connecting portions.

11 Claims, 8 Drawing Sheets

(56) References Cited

U.S. PATENT DOCUMENTS

| | | | | | |
|---|---|---|---|---|---|
| 2,789,797 | A | | 4/1957 | Simpelaar | |
| 3,205,560 | A | * | 9/1965 | Loehlein | F28F 1/12 29/890.042 |
| 3,266,661 | A | | 8/1966 | Dates | |
| 3,396,458 | A | * | 8/1968 | Meng | H05B 3/50 29/615 |
| 3,848,111 | A | | 11/1974 | Brouneus | |
| 4,286,377 | A | | 9/1981 | Hurko et al. | |
| 4,352,008 | A | * | 9/1982 | Hofer | H05B 3/50 165/183 |
| 4,414,052 | A | * | 11/1983 | Habata | H05B 3/14 156/252 |
| 4,471,213 | A | | 9/1984 | Yoshida | |
| 4,558,209 | A | * | 12/1985 | Hess | H05B 3/50 165/183 |
| 4,611,238 | A | | 9/1986 | Lewis et al. | |
| 4,715,430 | A | * | 12/1987 | Arnold | H01L 23/3675 165/185 |
| 4,820,903 | A | | 4/1989 | Ishida | |
| 4,822,980 | A | * | 4/1989 | Carbone | H05B 3/141 219/205 |
| 5,077,889 | A | * | 1/1992 | Matsuda | H05B 3/50 228/180.1 |
| 5,177,341 | A | | 1/1993 | Balderson | |
| 5,243,683 | A | | 9/1993 | Yang | |
| 5,753,893 | A | | 5/1998 | Noda et al. | |
| 6,089,314 | A | | 7/2000 | Becker et al. | |
| 6,735,082 | B2 | * | 5/2004 | Self | H01L 23/3677 165/185 |
| 6,852,955 | B1 | * | 2/2005 | Golan | C09J 9/02 219/505 |
| 7,082,032 | B1 | * | 7/2006 | Barsun | G06F 1/185 165/80.3 |
| 7,335,855 | B2 | * | 2/2008 | von der Luhe | H01C 1/014 219/201 |
| 7,355,148 | B2 | * | 4/2008 | Boussier | F24D 3/165 219/544 |
| 7,725,011 | B2 | * | 5/2010 | Boussier | F24D 3/165 392/407 |
| 8,051,896 | B2 | * | 11/2011 | Wayman | H01L 23/373 165/80.3 |
| 9,273,724 | B1 | * | 3/2016 | Rosenholm | F16C 33/107 |
| 9,338,827 | B2 | * | 5/2016 | Braun | H02B 1/565 |
| 2001/0001416 | A1 | | 5/2001 | Lee et al. | |
| 2004/0139709 | A1 | | 7/2004 | Illingworth et al. | |
| 2004/0244959 | A1 | * | 12/2004 | Chien | B23K 1/20 165/185 |
| 2004/0256380 | A1 | | 12/2004 | Wu | |
| 2006/0087398 | A1 | | 4/2006 | Wu | |
| 2006/0289475 | A1 | | 12/2006 | Tung et al. | |
| 2007/0033825 | A1 | | 2/2007 | Lo et al. | |
| 2007/0114219 | A1 | | 5/2007 | Rizzuto, Jr. | |
| 2008/0179314 | A1 | | 7/2008 | Colja et al. | |
| 2009/0000143 | A1 | | 1/2009 | Bazzicalupo et al. | |
| 2009/0178795 | A1 | * | 7/2009 | Wei | H01L 21/4882 165/185 |
| 2009/0194519 | A1 | | 8/2009 | Funaki et al. | |
| 2009/0293300 | A1 | | 12/2009 | Merritt | |
| 2010/0035024 | A1 | * | 2/2010 | Datta | C04B 37/026 428/172 |
| 2010/0111510 | A1 | | 5/2010 | Lo | |
| 2011/0079378 | A1 | * | 4/2011 | Bajusz | F28F 1/022 165/185 |
| 2013/0087549 | A1 | | 4/2013 | Wang | |
| 2019/0357653 | A1 | | 11/2019 | Guerreiro et al. | |
| 2019/0380463 | A1 | | 12/2019 | Guerreiro et al. | |

FOREIGN PATENT DOCUMENTS

| | | | |
|---|---|---|---|
| CN | 2345907 | | 10/1999 |
| CN | 1278745 | A | 1/2001 |
| CN | 2509489 | Y | 9/2002 |
| CN | 2597867 | Y | 1/2004 |
| CN | 2750243 | | 1/2006 |
| CN | 1882200 | A | 12/2006 |
| CN | 2917159 | Y | 6/2007 |
| CN | 101008287 | A | 8/2007 |
| CN | 201054804 | | 4/2008 |
| CN | 101289328 | | 10/2008 |
| CN | 101312603 | A | 11/2008 |
| CN | 201700020 | U | 1/2011 |
| CN | 102355758 | | 2/2012 |
| CN | 102423184 | | 4/2012 |
| CN | 102538547 | A | 7/2012 |
| CN | 102833896 | | 12/2012 |
| CN | 102883483 | A | 1/2013 |
| CN | 103079339 | A | 5/2013 |
| CN | 202918516 | U | 5/2013 |
| CN | 103546998 | | 1/2014 |
| CN | 103836595 | | 6/2014 |
| CN | 204757782 | U | 11/2015 |
| CN | 204968132 | U | 1/2016 |
| CN | 205624989 | U | 10/2016 |
| CN | 205909491 | U | 1/2017 |
| CN | 106604422 | A | 4/2017 |
| CN | 106859485 | A | 6/2017 |
| DE | 23 59 478 | | 6/1975 |
| DE | 26 26 409 | | 12/1977 |
| DE | 19637431 | A1 | 3/1998 |
| DE | 10109734 | | 9/2002 |
| DE | 10 2005 026 496 | | 7/2006 |
| DE | 102008003975 | | 7/2009 |
| EP | 0004145 | A1 | 9/1979 |
| EP | 0053508 | A1 | 6/1982 |
| EP | 0 207 677 | | 1/1987 |
| EP | 0 368 206 | | 5/1990 |
| EP | 0 942 468 | | 9/1999 |
| EP | 1070459 | | 1/2001 |
| EP | 1 657 993 | | 4/2008 |
| EP | 2 000 042 | | 12/2008 |
| ES | 2 217 989 | | 11/2004 |
| FR | 2142816 | | 2/1973 |
| FR | 2784274 | | 4/2000 |
| FR | 2 848 685 | | 6/2004 |
| FR | 2855709 | | 12/2004 |
| FR | 2 862 374 | | 5/2005 |
| GB | 883547 | | 11/1961 |
| GB | 1356753 | | 6/1974 |
| GB | 1539485 | | 1/1979 |
| GB | 1539485 | A | 1/1979 |
| GB | 2 261 351 | | 5/1993 |
| JP | 52-78838 | | 6/1977 |
| JP | S55-23672 | U | 2/1980 |
| JP | S55-55104 | U | 4/1980 |
| JP | 57-120047 | | 7/1982 |
| JP | 63-10563 | | 1/1988 |
| JP | 2-10683 | | 1/1990 |
| JP | 2-94384 | | 4/1990 |
| JP | 2-153868 | | 6/1990 |
| JP | 2-191303 | | 7/1990 |
| JP | 3-182088 | | 8/1991 |
| JP | 4-104493 | | 4/1992 |
| JP | 4-348701 | | 12/1992 |
| JP | H7-37095 | Y2 | 8/1995 |
| JP | H9-213455 | A | 8/1997 |
| JP | H10-160249 | A | 6/1998 |
| JP | 10-209357 | A | 8/1998 |
| JP | 2821749 | B2 | 11/1998 |
| JP | 11-017080 | A | 1/1999 |
| JP | 11-097156 | A | 4/1999 |
| JP | 2001-60784 | | 3/2001 |
| JP | 2003-068565 | A | 3/2003 |
| KR | 10-0503262 | | 7/2005 |
| KR | 10-2012-0019911 | | 3/2012 |
| KR | 10-2012-0071098 | A | 7/2012 |
| KR | 10-2012-0113927 | | 10/2012 |
| KR | 10-1277264 | B1 | 6/2013 |
| KR | 10-2015-0000234 | | 1/2015 |
| WO | WO-96/11372 | | 4/1996 |
| WO | 99/22844 | A1 | 5/1999 |
| WO | WO-2006/055946 | | 5/2006 |
| WO | 2007/135644 | | 11/2007 |

(56) References Cited

FOREIGN PATENT DOCUMENTS

| | | | |
|---|---|---|---|
| WO | 2007/135773 | A1 | 11/2007 |
| WO | 2012/087021 | | 6/2012 |
| WO | 2017/046559 | A1 | 3/2017 |
| WO | 2018/130832 | A1 | 7/2018 |

OTHER PUBLICATIONS

Notification of Reason for Rejection dated Jul. 29, 2019, directed to JP Application No. 2018-091457; 6 pages.
Search Report dated Oct. 12, 2017, directed to GB Application No. 1707513.6; 2 pages.
International Search Report and Written Opinion dated Jun. 11, 2018, directed to PCT/GB2018/050070; 16 pages.
International Search Report and Written Opinion dated Sep. 18, 2018, directed to PCT/GB2018/051028; 17 pages.
Further Search Report dated Apr. 10, 2018, directed to GB Application No. 1707513.6; 2 pages.
Examination Report dated Feb. 27, 2020, directed to GB Application No. 1707513.6; 3 pages.
Examination Report No. 1 for standard patent application dated May 15, 2020, directed to AU Application No. 2018265351; 7 pages.
Office Action dated Oct. 28, 2020, directed to JP Application No. 2019-233802; 4 pages.
The First Office Action dated Nov. 27, 2020, directed to CN Application No. 201880052111.3; 19 pages.
Written Opinion dated Nov. 12, 2020, directed to SG Application No. 11201909639Y; 7 pages.
Office Action received for Chinese Patent Application No. 201810441952.5, dated Jul. 28, 2021, 21 pages (13 pages of English Translation and 8 pages of Original Document).
Office Action received for European Application No. 18721112, dated Jul. 1, 2021, 6 pages.
First Office Action and Search Report received for Chinese Patent Application No. 201880006876.3, dated Aug. 31, 2021, 19 pages (11 pages of English Translation and 8 pages of Original Document).

* cited by examiner

HEATER

REFERENCE TO RELATED APPLICATIONS

This application claims the priority of United Kingdom Application No. 1707513.6, filed May 10, 2017, the entire contents of which are incorporated herein by reference.

FIELD OF THE INVENTION

This invention relates to a heater and in particular a heater for a hand held appliance, for example a hair care appliance.

BACKGROUND OF THE INVENTION

Hand held appliances such as hair care appliances and hot air blowers are known. Such appliances are provided with a heater to heat either fluid flowing through the appliance or a surface at which the appliance is directed. Most devices are either in the form of a pistol grip with a handle including switches and a body which houses components such as a fan unit and a heater. Another form is for a tubular housing such as found with hot styling devices. Thus, generally the option is to have fluid and/or heat blowing out of an end of a tubular housing and either to hold onto that housing or be provided with a handle orthogonal to the tubular housing.

Traditional heaters are often made from a scaffold of an insulating and heat resistant material around which a resistive wire such as nichrome wire is wound. Such heaters can produce power outputs of up to around 1200 to 1500 W which are suitable for hair care appliances however these heaters are relatively heavy and to achieve such power outputs requires complex packaging of metres of wiring. A different type of heater can be made using the properties of a power self-limiting positive temperature coefficient (PTC) material, for example a doped barium titanate oxide, which is sandwiched between two conducting surfaces. Heat is dissipated into an airflow using fins. A single PTC heater can achieve up to around 200 W and a temperature of up to 260° C. and can be used in series (subject to an increase in the size and weight of the appliance) to increase the power and therefore the heat that can be produced.

SUMMARY OF THE INVENTION

According to some embodiments, a high power density heater has the advantages of being lightweight, with simplified packaging where the heater element can withstand operating temperatures of at least 400° C. In some embodiments, a single heating element may be provided. Throughout this specification, the term heater element refers to the resistive track which is embedded into a ceramic material and the heater comprises the heater element along with heat dissipating elements.

According to some embodiments, a heater may include a high temperature co-fired ceramic (HTCC) heating element. Fins may be attached to each side of the heating element to enhance heat dissipation. The fins may be made from a thermally conducting material, for example copper, aluminium or their alloys which are attached to the heating element. There may a mismatch in thermal conductivity between the heater element and the heat dissipation fins. This may cause a number of issues. Firstly, when the fins are attached, the process may be carried out at a high temperature. This can create residual stresses at the interface between the ceramic and the metal as the part is cooled. The ceramic can also fracture when first cooled down in the furnace if the stress in the ceramic exceeds a critical limit. The thermal cycle of the process may be important to limit this. Secondly, the heater will be cycled between room temperature and the maximum operating temperature of the appliance during use and this cycling can cause a build-up of residual stress which may lead to failure if it exceeds a critical limit.

The thermal stresses are less critical in a low power heater as the energy being provided to the heater element and the maximum temperature achieved at the joint is significantly less. Additionally, the manufacture of the heater can use room temperature bonding methods as the temperature reached by the heater during use is significantly reduced. Thus, according to some embodiments, a ceramic heater has an element capable of withstanding a power input of up to 1800 W.

As well as the mismatch of thermal expansion coefficient there is the bond between the ceramic material and the fins. At the bond there is an interface between the two materials that allows for the thermal expansion mismatched materials to interact, which may raise stress at the interface, and which may result in failure of one or both materials. The bond should be sufficient to achieve adequate heat exchange between the heater element and the fin and to withstand the thermal cycling that an appliance containing the heater would see during its lifetime. Thus, the fatigue strength of the joint should be sufficient to withstand thermal cycling of the interface between room temperature and peak operating temperature and the melting point of the constituent parts should be higher than the max operating temperature of the interface.

In a first embodiment, a heater comprises a ceramic heater element and at least two fins for dissipating heat from the ceramic heater element, wherein the ceramic heater element extends along a plane in one dimension and the at least two fins extend away from the plane, and wherein the at least two fins are connected to the ceramic heater element via discrete connecting portions.

Having discrete connecting portions means that the fin is not connected along its entire length; there are gaps or breaks in the connection. These gaps enable the stress between the fin and the heater element to be relieved. When the heater is at high temperature or transitioning to or from ambient temperature, the fin material will expand or contract more than the heater element. The gaps or breaks enable the fin material to expand and deform somewhat without causing excessive stress to the heater element. In other words for a given temperature rise, the stress between the heater element and fins is reduced when such gaps are introduced.

Preferably, the discrete connecting portions are a plurality of substantially similar areas of contact between the ceramic heater element and the at least two fins. This uniformity is beneficial as without it, the thermal mismatch would vary along the length of the fin at its interface with the heating element causing certain areas to be more prone to cracking and/or debonding.

In a preferred embodiment, the discrete connecting portions are each separated by a similar sized gap and distance between gaps (gap frequency). Again this uniformity is beneficial for a uniform shaped heater as without it, the thermal mismatch would vary along the length of the fin causing certain areas to be more prone to cracking and/or debonding. Alternatively, for a non-uniform heater for example a curved heater, different gap sizes and gap frequency can be applied in adjacent regions of the heater to deliver appropriate stress relieve dependent on operating temperature.

The fin is formed from a metal sheet which is processed to produce the discrete connecting portions. The fin preferably has a thickness of 0.2 mm to 0.5 mm. In one embodiment, the gaps between the discrete connecting portions are formed by electric discharge machining (EDM). This effectively produces a plurality of parallel slots that extend from one edge of the metal sheet towards the distal end. A second stage is to produce the discrete connecting portions; this is achieved by bending the metal sheet in a 90° V-press tool. This forms a plurality of "L-shaped" features having a leg portion which forms part of the fin proper and a foot portion which forms the discrete connecting portion for each leg.

Preferably, the fin has a thickness and a gap size between adjacent discrete connecting portions is between 0.8 and 1.2 times the fin thickness.

In a preferred embodiment, the ceramic heater element comprises an electrically resistive track located between layers of ceramic material. Preferably, the ceramic heater element is an HTCC, meaning that the track is applied to ceramic material in its green state, covered with another layer of the ceramic material and then the heater element is sintered as a single unit.

Preferably, the at least two fins are disposed on each side of the ceramic heater element. This also assists in thermal management of the heater as heat is drawn and dissipated on both sides of the heater from a centrally located resistive track. It also tends to protect the heater element from flexural loads during thermal cycling.

Preferably, the heater comprises a plurality of fins extending from both sides of the ceramic heater element. The ceramic heater element extends from a first edge to a second edge along the plane. In a preferred embodiment, the plurality of fins vary in height from the first edge to the second edge. As hand held appliances and in particular hair care appliances are often tubular in shape, this enables a traditional shape for the heater to be used.

In addition, it is advantageous that the plurality of fins are substantially equally spaced between the first edge and the second edge. This again assists in managing the thermal mismatch across the fin by reducing the thermal gradient across the ceramic heating element. Thus the gaps between the discrete portions manage the stresses caused by the difference in the thermal expansion coefficient in one direction and the spacing between the fins manages the stresses caused by the difference in the thermal gradient in a second direction.

As previously described, it is known to produce PTC heaters in hair care appliances but to produce low power heaters. The PTC material is a ceramic, which is sandwiched between two conducting surfaces. These can be formed in a honeycomb shape where air flows through the apertures formed by the honeycomb. The heat transfer rate can be improved by adding heat dispersing features to the electrodes and this is relatively simple as the electrodes are formed from a conductive, usually metallic, material and the heat dispersing features are also thermally conductive so a metal is generally used so attaching one to the other can be done easily. The two parts can be glued together to form a good bond. There are minimal issues relating to thermal expansion firstly, as the PTC heater does not reach the higher temperatures needed for a higher power heater and secondly the glue is a flexible material, the mismatch at the interface is resolved by this layer.

Another aspect to the invention relates to attaching a metal heat dispersing fin to a ceramic surface.

According to some embodiments, a method of attaching a metal fin to a ceramic heater element includes the steps of:

(a) applying a filler material to a surface of the ceramic heater element;

(b) positioning a metal fin over the filler material to produce a heater template;

(c) brazing the heater template in a furnace at a temperature of between 750° C. and 900° C. to melt the filler and cause the filler and the ceramic heater element to react together.

Preferably, the filler material is an alloy including silver, copper and titanium. More preferably, the alloy is formed from an initial composition of 72% silver and 28% copper to which 1-5 weight % titanium is added. The titanium increases reactivity and reacts with the ceramic heater element forming complex inter-metallic phases. The temperature must be high in order to melt the filler material but not so high as to melt the metal fin. The fin is preferably made from one of copper, stainless steel and kovar.

Preferably, the method includes the additional steps of:

(i) coating a surface of the ceramic heater element with a metallisation paste;

(ii) sintering the coated ceramic heater element;

(iii) electroless plating of a nickel layer on the sintered coated ceramic heater element to produce a primary metallised surface;

(iv) applying a flux to the primary metallised surface; wherein steps (i) to (iv) are carried out prior to step (a) and wherein step (c) additionally melts the flux located between the metal fin and the primary metallised surface and is carried out at a temperature of around 600° C.

According to some embodiments, an alternative method of attaching a metal fin to a ceramic heater element includes:

(a) coating a surface of the ceramic heater element with a metallisation paste;

(b) sintering the coated ceramic heater element to produce a primary metallised surface;

(c) electroless plating of a nickel layer on the sintered coated ceramic heater element to produce secondary metallisation layer over the primary metallisation layer;

(d) heating the nickel plated ceramic heater element to diffuse the nickel layer into the primary metallisation layer;

(e) applying a flux to the metallised surface to produce a metallised surface;

(f) applying a filler material over the flux;

(g) positioning a metal fin over the filler material to produce a heater template;

(h) brazing the heater template in a furnace to melt the filler and flux located between the metal fin and the metallised surface.

Preferably the brazing is carried out at between around 550° C. and 650° C. Most preferably the temperature is 610° C.

Preferably, the ceramic heater element is a multi-layered ceramic substrate comprising a resistive track printed onto an internal layer whilst the substrate is in its green state. Preferably, the resistive track is tungsten. The ceramic material is one of aluminium nitride, aluminium oxide, silicon nitride beryllium oxide, zirconia and silicon carbide. Preferably, the ceramic material is aluminium nitride. The temperature at which the ceramic heater element is sintered will depend on the material used amongst other things, in the case of aluminium nitride, the temperature is preferably above 1800° C.

Preferably, the metallisation paste comprises ceramic material used to form the ceramic heater element, a refractory material such as tungsten plus binders and fillers. In a preferred embodiment, the refractory material is one of tungsten, platinum, molybdenum or their alloys. Preferably, the refractory material is tungsten. It is preferred that the metallisation paste is applied to the ceramic heater element at a thickness of 10 to 12 microns.

Preferably, the coated ceramic heater element is sintered under the same conditions as the ceramic heater element. This is advantageous especially when the same ceramic material is used as the shrinkage of the coating will be substantially similar to the shrinkage of the ceramic heater element so thermal stresses between the two layers will be minimised.

Preferably, the nickel layer is electroplated via brush electroplating, dip electroplating or electroless plating. In a preferred embodiment, a 3-5 micron thick layer of nickel is plated.

Preferably, the flux is applied to the metallised surface as a paste. Preferably, the filler material is made from a foil.

Preferably, the metal fin is formed from an aluminium alloy. Whilst other metals and alloys are suitable, for example, copper, stainless steel and kovar, it is preferred to use a material having a relatively low elastic modulus and a lower yield strength. A lower elastic modulus reduces the amount of stress at the ceramic-fin interface due to thermal expansion induced strain. A lower yield strength means that the metal is more likely to deform at higher temperatures which reduces the stress on the ceramic around the joint.

In a further embodiment, a method of manufacturing a ceramic heater element capable of operating at a temperature of 400° C. includes:

(a) producing an HTCC heater element;

(b) coating a surface of the ceramic heater element with a metallisation paste;

(c) sintering the coated ceramic heater element to produce a primary metallised surface;

(d) electroless plating of a nickel layer on the sintered coated ceramic heater element to produce a produce secondary metallisation layer over the primary metallisation layer;

(e) heating the nickel plated ceramic heater element to diffuse the nickel layer into the primary metallisation layer to produce a metallised surface;

(f) applying a flux to the metallised surface;

(g) applying a filler material over the flux;

(h) producing a heat dispersing fin having a plurality of discrete connecting portions wherein each adjacent pair of discrete connecting portions is separated by a space;

(i) positioning a heat dissipating fin over the filler material whereby the plurality of discrete connecting portions are adjacent the filler material to produce a heater template;

(j) brazing the heater template in a furnace to melt the filler and flux located between the metal fin and the metallised surface.

Preferably, the discrete connecting portions are a plurality of substantially similar areas of contact between the ceramic heater element and the at least two fins. In a preferred embodiment, the discrete connecting portions are each separated by a similar sized gap or space.

Preferably, the gaps or spaces between the discrete connecting portions are formed by EDM. This effectively produces a plurality of parallel slots that extend from one edge of the metal sheet towards the distal end. A second stage is to produce the discrete connecting portions; this is achieved by bending the metal sheet in a 90° V-press tool. This forms a plurality of "L-shaped" features having a leg portion which forms part of the fin proper and a foot portion which forms the discrete connecting portion for each leg.

Preferably, the heater comprises a plurality of heat dissipating fins which extend from both sides of the ceramic heater element.

In a preferred embodiment, the ceramic heater is formed from a rectangular ceramic heater element resulting in a generally tubular or square heater. Alternatively, the ceramic heater element is arcuate. Preferably, the arcuate ceramic heater element has a constant curvature. In a preferred embodiment, the arcuate ceramic heater element in formed having an inner radius and an outer radius which both extend from a common origin.

For an arcuate heater, the fins are preferably curved. More preferably, the fins match the curvature of the ceramic heater element. To form curved fins, following the second stage of production where the discrete connecting portions are formed, there is a third stage of stamping the fins is a curved tool.

For this embodiment, it is advantageous to varying the spacing of the fins between the inner radius and the outer radius of the ceramic heater element. The spacing between adjacent fins increase from the inner radius to the outer radius. The reason for this is twofold, firstly as the path length within the heater is shorter at the inner radius it is less restrictive for the fluid flowing through the heater, thus to get a more even flow across an outlet of the heater it needs to be made more restrictive. Secondly, as the path length is longer at the outer radius the dwell time is longer so fluid flowing through this part can be relatively hotter than the fluid flowing at the inner radius. Thus, by making the spacing larger at the outer radius there is more fluid flowing through that region which makes the thermal variation at the heater outlet less. The variation in air outlet temperature across the exit plane is lower, and the variation in temperature across the ceramic heating element is lower

BRIEF DESCRIPTION OF THE DRAWINGS

The invention will now be described by way of example, with reference to the accompanying drawings, of which.

DETAILED DESCRIPTION OF THE INVENTION

According to some embodiments, a method includes a first step of making an HTCC heater element. Three exemplary materials for the element include aluminium oxide, aluminium nitride and silicon nitride. Commercially available materials may be used. For example, materials commercially available from Precision Ceramics (e.g., with the grade of alumina being 99.6% alumina, product description AT 79, the grade of aluminium nitride available in 2015, and the silicon nitride, product description SL 200 BG). The ceramic heater elements may be formed initially from a rectangular substrate which when sintered forms 70 mm×30 mm×0.5 mm coupons. A first layer of the green state ceramic may have a tungsten track screen printed onto a surface. The tungsten may be formed into a slurry with material of the same composition as the ceramic used to form the heater element and then a second layer of the green state ceramic may be applied. This may be sintered at over 1000° C., for example, around 1800° C. The resulting embedded tungsten track may have a thickness of 18-20 microns. FIG. 3 shows an example of two tracks 300, 310. The skilled person will appreciate that different ceramic compositions and sizes of coupons will require different sintering conditions and that such information is widely available in a multitude of text books.

Table 1 shows different exemplary combinations of ceramic and metal that were evaluated.

TABLE 1

| | Copper C103 | Stainless Steel S430 | | Kovar | |
|---|---|---|---|---|---|
| Ceramic | Single sheet | Single sheet | Multi-section | Single sheet | Multi-section |
| $Al_2O_3$ | 5 coupons | 5 coupons | 5 coupons | 5 coupons | 5 coupons |
| $Al_3N_4$ | 5 coupons | 5 coupons | 5 coupons | 5 coupons | 5 coupons |
| $Si_3N_4$ | 5 coupons | 5 coupons | 5 coupons | 5 coupons | 5 coupons |

Figure 1:
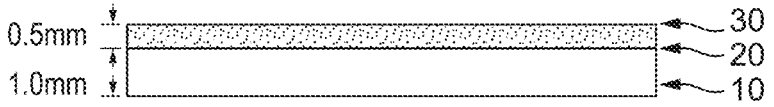
FIG. 1 shows a side view of a brazed sample.
Figure 2:
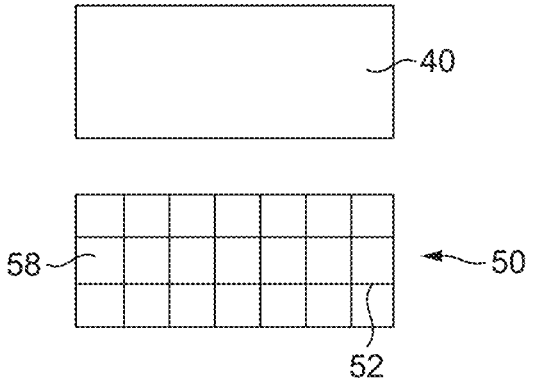
FIG. 2 shows the surface profile of a standard sheet and a multi-sectioned sheet prior to brazing.

The brazing process was carried out on coupons (rectangular portions) of 70 mm×30 mm×0.5 mm of the ceramic heater element 10 in a vacuum furnace at 850° C. using a braze filler 20. The braze filler was 0.05 mm thick foil of AgCuTi active brazing, the metal 30 was only applied to one side of the ceramic which resulted in post brazing warpage and could account for some of the failures. Table 2 details the post brazing survival rate for the different combinations. FIG. 1 shows a side view of the construction and FIG. 2 details the difference between the single sheet 40 of the metal and the multi sections sheet 50. The multi sectioned sheet 50 was a first attempt to relieve the stress by having a discontinuous bond between the ceramic and the metal material. Relief cuts 52 were made into the metal in two directions on the side to be bonded to the ceramic heater element 10.

TABLE 2

| | Copper C103 | Stainless Steel S430 | | Kovar | |
|---|---|---|---|---|---|
| Ceramic | Single sheet | Single sheet | Multi-section | Single sheet | Multi-section |
| $Al_2O_3$ | 100% (5/5) | 0% (0/5) | 0% (0/5) | 100% (5/5) | 80% (4/5) |
| $Al_3N_4$ | 100% (5/5) | 0% (0/5) | 0% (0/5) | 0% (0/5) | 20% (1/5) |
| $Si_3N_4$ | 100% (5/5) | 0% (0/5) | 0% (0/5) | 60% (3/5) | 40% (2/5) |

Without being bound by any theory, it is thought that the stainless steel samples failed as a result of the brazing process being below the temperature of plastic deformation for this alloy thus, the metal side of the joint can only deform elastically which introduces stress into the joint. Conversely, copper can yield to reduce the build-up of stresses.

Figure 4A:
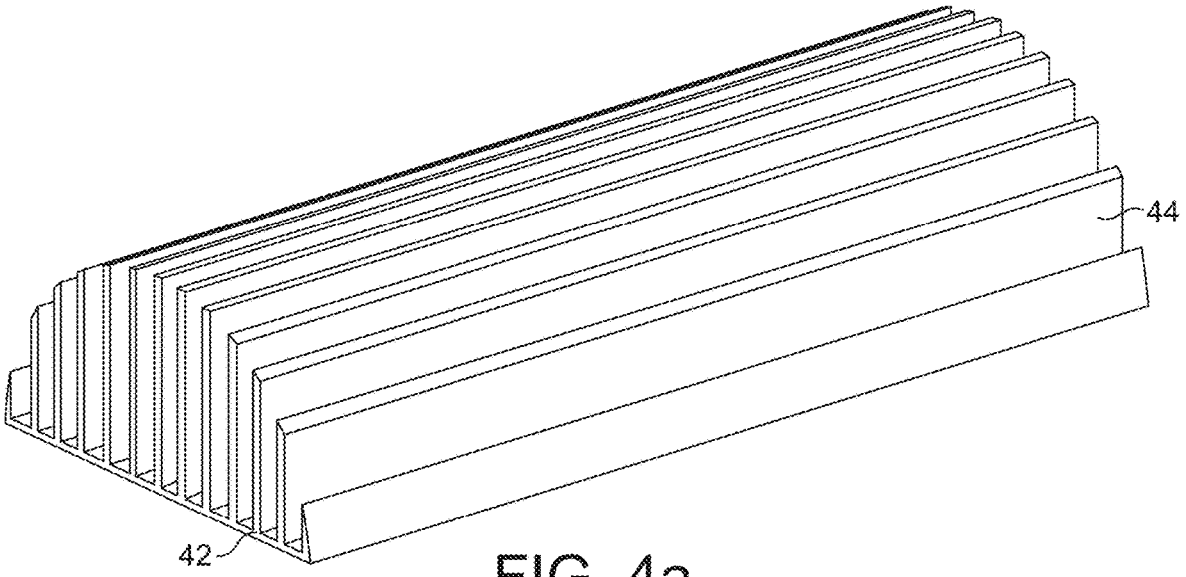
FIG. 4*a* shows the base and fin geometry on a rectangular ceramic heater element.
Figure 4B:
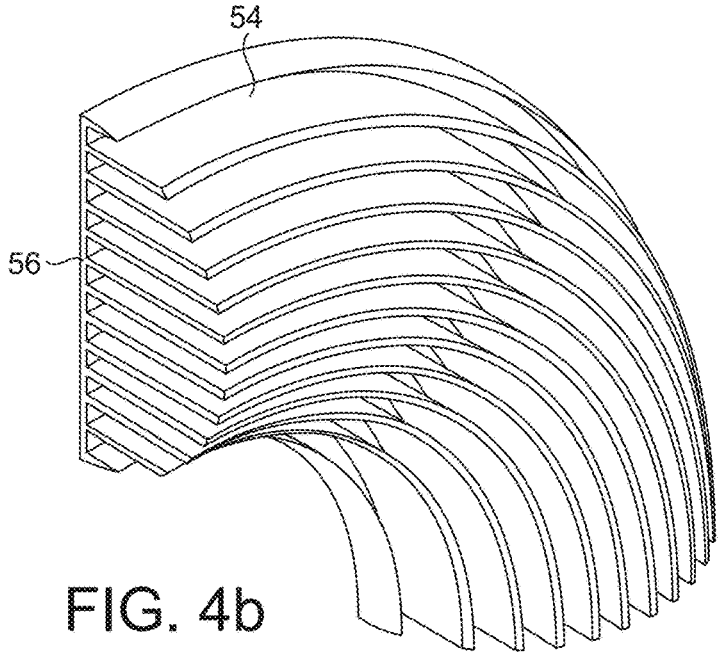
FIG. 4*b* shows the base and fin geometry on a arcuate ceramic heater element.
Figure 5A:
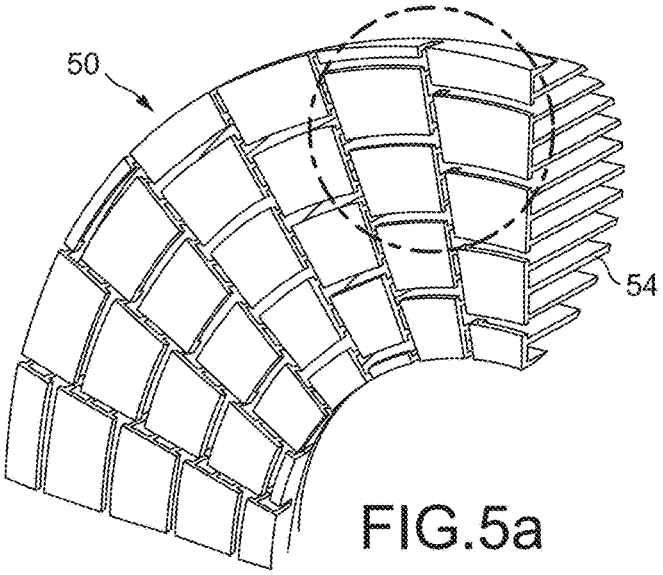
FIG. 5*a* shows a multi-sectioned base.
Figure 5B:
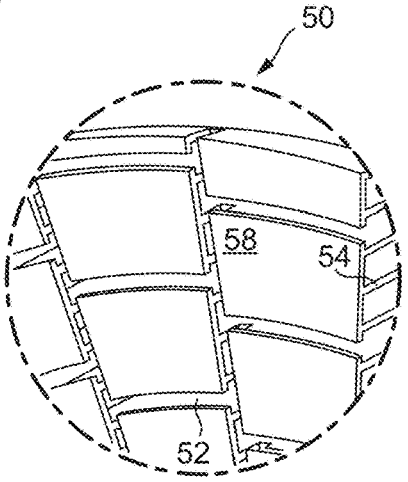
FIG. 5*b* is an expanded view of a portion of FIG. 5*a;*

A further investigation used heat dissipating fins. The fins 44, 54 are planar sheets which extend orthogonally away from a base portion 42, 56 respectively. In FIG. 4*a* the base portion 42 is a single rectangular sheet with integral fins 44. The fins 44 and base 42 are formed from a block of copper which is machined to remove the material between the fins 60. In FIG. 4*b* the fins 54 and base 56 are also integral and formed from an arcuate block of copper which is machined to produce arcuate fins 54 integral to an arcuate base 56. FIGS. 5*a* and 5*b* show a multi sectioned sheet 50 with integral heat dissipating fins 54. These samples were formed from a block of Kovar which was machined to remove the material from between the fins 54 and to provide the relief cuts 52 in the base to provide discrete connecting portions 58. The same fin geometry was used on the straight or rectangular samples and the same brazing conditions. The brazing survival rates are shown in Table 3.

TABLE 3

| | Copper C103 | | Kovar |
|---|---|---|---|
| Ceramic | Straight | Curved | Straight |
| $Al_2O_3$ | 0% (0/3) | 0% (0/1) | 67% (2/3) |
| $Al_3N_4$ | 67% (2/3) | 100% (1/1) | 33% (1/3) |

The surviving samples were tested by thermally cycling them but all failed by cracking at the metal ceramic joint due to a build-up of stress. For the copper samples this is believed to be via cold working which increases the strength of the copper over time along with a mismatch ion the coefficient of thermal expansion.

Figure 6:
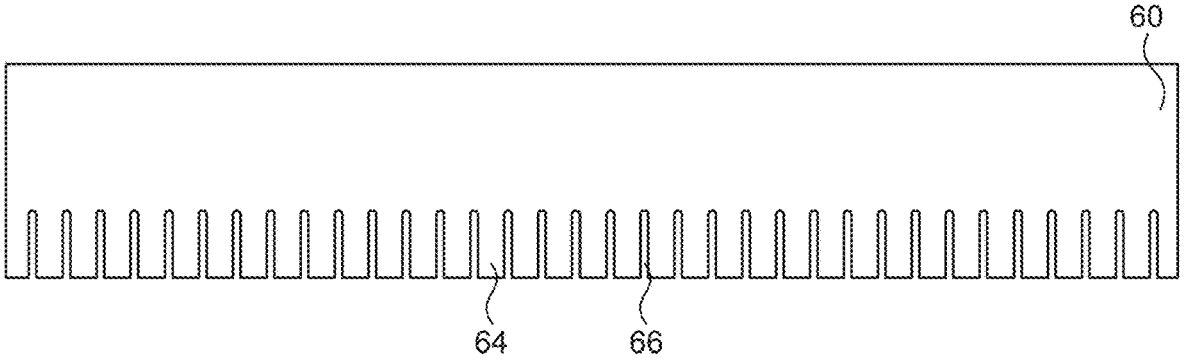
FIG. 6 shows a heat dispersing fin having discrete connecting portions.

A third trial was carried out using an aluminium heat dispersing fin 60 (FIG. 6). The specific alloy chosen was (Al 1050-O) as the material properties of this alloy are more conducive to making a successful heater as it has a lower yield strength and is less work hardening.

Referring now to FIGS. 6 to 11*b*, the heat dispersing fins 60 in this trial had a much smaller footprint on the ceramic heater element. Individual fins made from aluminium 1050-O sheets having a thickness t of 0.3 mm and 0.5 mm included discrete contacting portions 62 at the base create a multi-sectioned interface with the ceramic. The fin assemblies 160 were identical on each side of the ceramic heater element to balance the momentum on the ceramic. The contact points 1 and d of the fins were 2 mm×2 mm but further tests were also carried out with 1.5 mm×1.4 mm (see FIGS. 10*a* and 10*b*). Each fin 60 is made from stamped metal sheet which reduces raw material costs and the manufacturing complexity from the previous complex 3-dimensional shape that required either milling or metal injection moulding.

For straight fins, the metal sheet profiles were cut with EDM wire (FIG. 6); and the feet are bent with a 90° V-press tool. For curved profiles, there is a final curved stamping process.

Figure 12A:
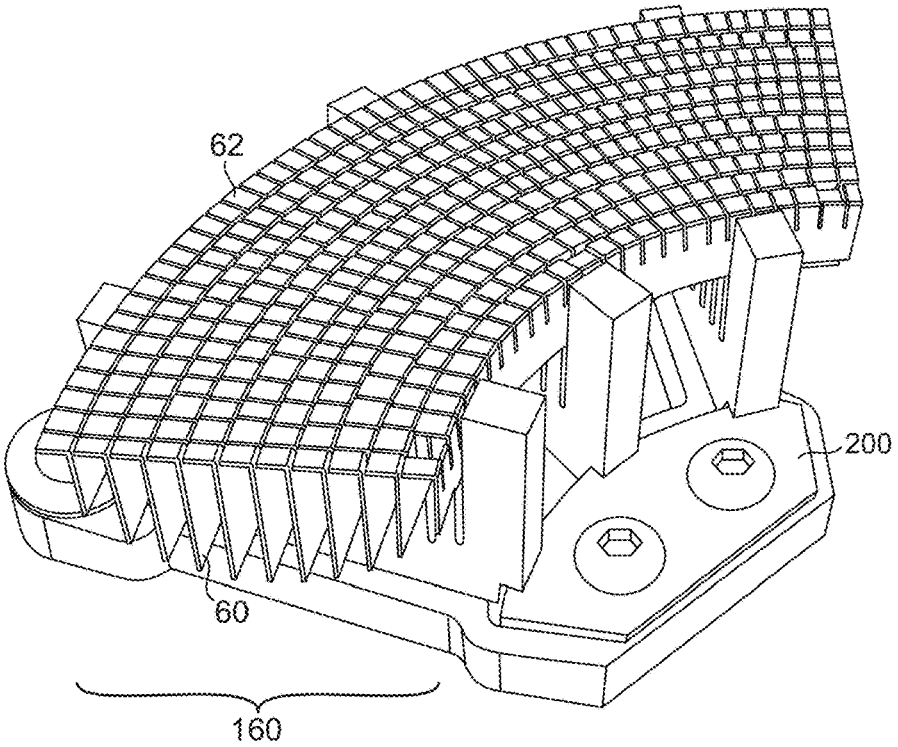
FIG. 12*a* shows a first side of a retaining structure for a heater prototype.
Figure 12B:
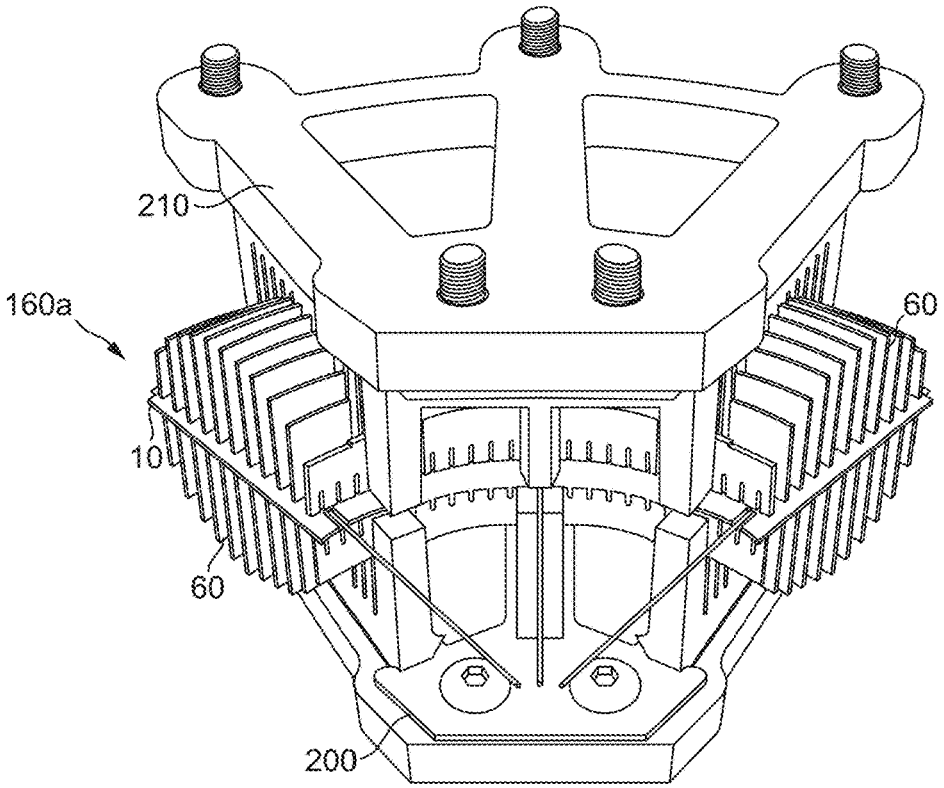
FIG. 12*b* shows an assembled retaining structure for a heater template.

Having individual fins 60 may require a fixture to keep all fins in place during brazing; the material chosen was graphite due to the temperatures of the brazing process and as it would not react. A fixture was designed and is shown in FIGS. 12*a* and 12*b*. A first part 200 retains one side of the fins, the ceramic heating element 10 is aligned and then a second part 210 of the fixture containing the other side 160*a* of the fins 60 is attached.

As the fins are aluminium, active brazing was not used (the temperature is too high).

The process was carried out as follows. First the surfaces of the ceramic heater element 10 were first cleaned thoroughly then coated with a primary metallizing layer 100. This is a 10-12 micron tungsten layer which is screen printed onto each side of the ceramic heater element. The tungsten is applied as an element in a metallisation paste and then coated part is sintered. The same ceramic material is used as a component in the tungsten paste so the same sintering conditions are used.

The secondary layer 110, on top of the tungsten, is a 3-5 micron electroless nickel coating. For this trial the nickel alloy used was Ni-11P coating (near the eutectic). The process is also known as an 'electrolytic' or 'autocatalytic' process. This nickel layer prevents surface oxidation of the tungsten layer in air and improves wetting of the braze filler. A heat treatment at approximately 800° C. in a reducing atmosphere is used to diffuse this layer into the tungsten primary layer.

As an alternative to using electroless plating, other forms of electroplating can be used, for example brush electroplating or dip electroplating.

A flux material is applied to each electroplated surface. One example of a flux is Harris Al braze-1070 flux which was applied using a brush applicator. On each side of the metallised ceramic heater element 100, 110 initially 0.082+/−0.003 g was used. In a further test 0.0808+/−0.002 g was added per side. The flux material contains both aluminium and silicon and melts during the brazing process, removing oxides and improving the wetting of the surfaces. The addition of silicon as an alloying element in the filler lowers the melting point and the viscosity of the molten metal, which improves the alloy's gap-filling capability. The eutectic composition allows the lowest melting point of the binary alloy, and lowest viscosity (a transition from a single solid phase to a single liquid phase).

Finally, a braze filler material 120 is applied over the flux material. An example of a filler material is Prince and Izant Al-718. This is provided as a foil which is 590 microns thick. In a first example a single sheet of the foil was used providing 0.271+/−0.004 g of filler material per side. A second example used 0.527+/−0.006 g of filler material per side (two 50 micron foil layers per side).

Another example of a suitable material is NOCOLOK® Sil Flux" from Solvay. This combines filler and flux in one paste so removes the need for two step application.

The heat sink material chosen was Al1050-O grade which is a commercially pure grade that has undergone an annealing heat treatment process. The heat sink is a non-traditional 'finned heat sink' because the 'heat sink base' has been removed and only the fins are used. These fins are directly bonded to the heat generating surface using a 'flanged tee' joint.

The fins 60 are created from rolled sheet through EDM wire cutting and bending processes. As part of the cutting process, small cuts are created at the bottom of the fins. This effectively produces a plurality of legs 64 and inbetween each adjacent pair of legs, parallel slots 66 that extend from one edge of the metal sheet towards the distal end. A second stage is to produce the discrete connecting portions; this is achieved by bending the metal sheet in a 90° V-press tool. This forms a plurality of "L-shaped" features having a leg 64 which forms part of the fin proper and a foot portion which forms the discrete connecting portion 62 for each leg.

The brazing process is carried out in a furnace. Some samples were brazed in a vacuum furnace but this was found to be unnecessary and increased the dwell time required as only radiation was used to heat the sample. Further processes were carried out in a reducing atmosphere at approximately one atmosphere of pressure. The heater template is assembled within an enclosure 200, 210 and placed in the furnace at room temperature and then heated to around 610° C. in an atmosphere of 95% nitrogen and 5% hydrogen. The heating process took around an hour, in this case this was the highest for the furnace used and potentially higher rates could be used which would reduce the brazing time. The temperature was held for a pre-determined time and then cooled to room temperature. The pre-determined time was around 2 minutes, but this is dependent on the thermal mass of the enclosure 200, 210 and the heater so is subject to change dependent on these factors.

After removal from the furnace, the heater was washed in an ultrasonic hot water bath at 40° C. to remove flux residue from between the discrete connecting portions.

Theoretically, this joint should not work due to Coefficient of Thermal Expansion (CTE) mismatch between the ceramic and the metal. Also, if the two materials were joined without fracture of the ceramic, the joint would not survive many thermal cycles.

By using individual fins 60, there is a reduction in the contact area between the heat sink and the ceramic heating element 10 this limits the problems caused by the mismatch is thermal expansion coefficient in one orientation—across the width of the ceramic heater element. In addition, by having the discrete points of contact 62 along each individual fin 60, the problem caused by the mismatch is thermal expansion coefficient in another orientation—along the length of the ceramic heater element 10. The discrete connecting portions act as stress relief cuts.

Figure 7A:
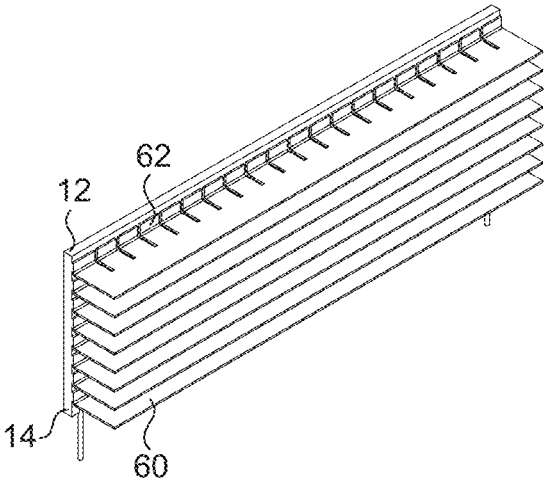
FIG. 7*a* shows an isometric view of a set of fins brazed to a rectangular ceramic heater element.
Figure 7B:
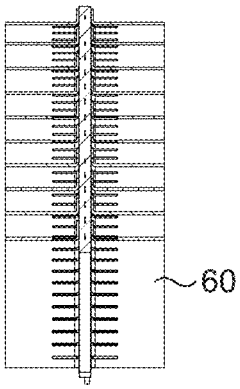
FIG. 7*b* shows a different view of two sets of fins brazed to an arcuate ceramic heater element.
Figure 8A:
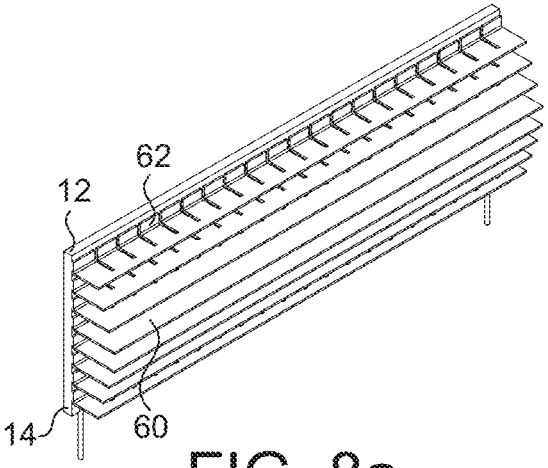
FIG. 8*a* shows an isometric view of a set of varying height fins brazed to a rectangular a ceramic heater element.
Figure 8B:
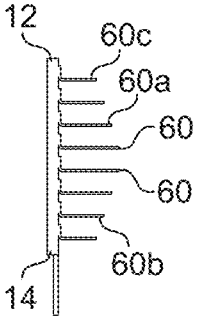
FIG. 8*b* shows a side view of a set of varying height fins brazed to a ceramic heater element.

A few variations in the form of the ceramic heater will now be discussed. The fins 60 may be all of the same height as shown in FIGS. 7*a* and 7*b*. This is the simplest embodiment of the brazed heater. As most hair care appliances have a tubular casing, the fins can be made of a varying height. FIGS. 8*a* and 8*b* show this. At least one fin 60 is at the maximum height. In this example two fins 60 are of the maximum height and to make the heater tubular these are located in the middle of the ceramic heater element. The ceramic heater element 10 is defined by a first edge 12 and a second edge 14 so the middle of the ceramic heater element 10 is between these edges. As we approach either of the first edge 12 and the second edge 14, the fins 60*a*, 60*b*, 60*c* get progressively shorter in height to form the tubular shape.

Figure 3A:
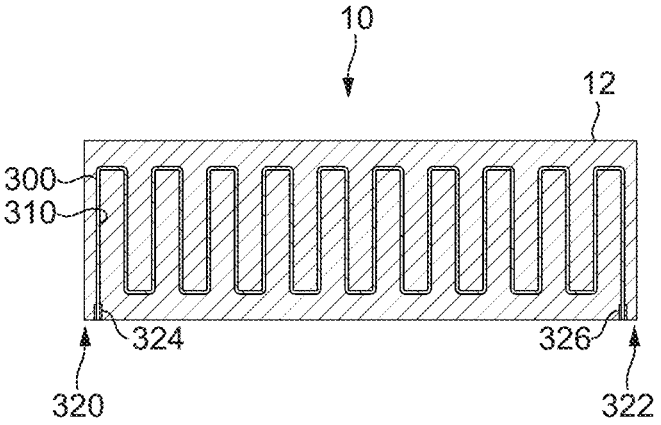
FIG. 3*a* shows an example of a track layout on a rectangular heating element.

As previously described, FIG. 3*a* shows an example of heater tracks 300, 310 in a rectangular ceramic heater element. In this example power to both tracks 300, 310 is provided at a first end 320 of the ceramic heater element via a first pair of connectors 324 and a second pair of connectors 326 is provided at a second end 322 of the ceramic heater element 10. As the skilled person will know, the connectors can be positioned at different locations along the ceramic heater element.

Figure 3B:
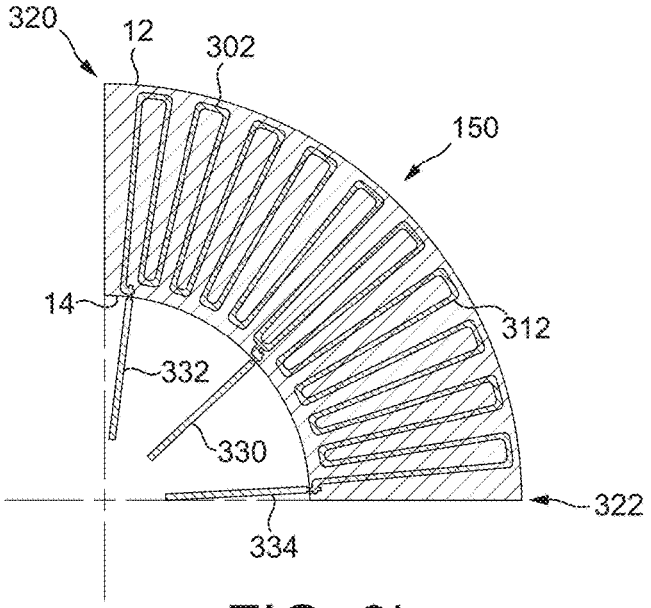
FIG. 3*b* shows an example of a track layout on an arcuate heating element.

FIG. 3*b* shows an arcuate ceramic heater element 150. In this example the two heater tracks 302, 312 are not adjacent as before, rather they are side by side and share a common connection 330 which is located centrally along the length of the ceramic heater element 150 between the first end 320 and the second end 322. This common connector can be either the live or neutral connector. For the first track 320 a second connector 332 is provided adjacent the first end 320 of the ceramic heater element 150 and for the second track 312 a second connector 334 is provided adjacent the second end 322 of the ceramic heater element 150. These second two connectors 332, 334 are the other of the live and neutral connectors.

Figure 13A:
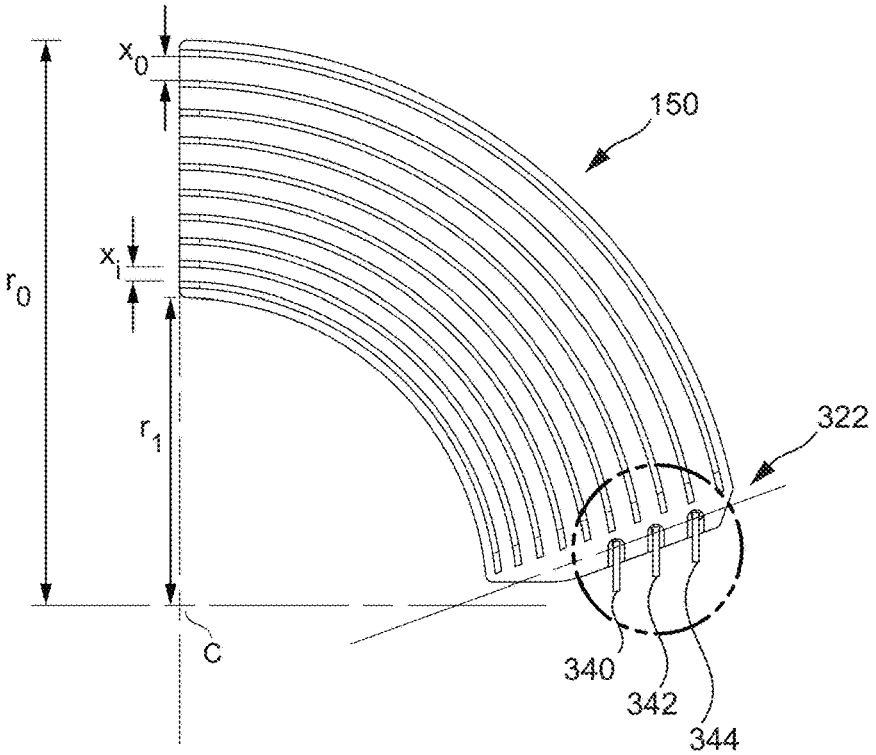
FIG. 13*a* shows a side view of fins of varying spacing.
Figure 13B:
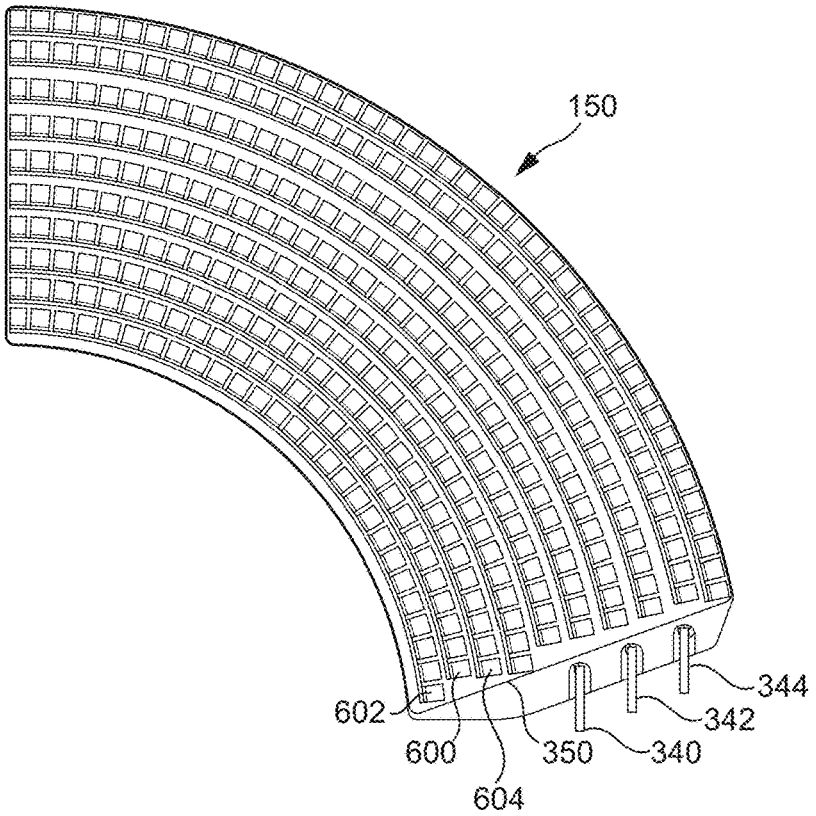
FIG. 13*b* shows a side view of fins having staggered discrete connecting portions.

As an alternative to the connectors being provided along an edge of the ceramic heater element 150, FIGS. 13*a* and 13*b* show a different arrangement. In these examples the heater tracks are interlaced as with FIG. 3*a* but all the connectors 340, 342, 344 are provide at a first end 332 of the ceramic heater element 150. Again one of the connectors 344 is a shared connector and provided either the live or the neutral connector to the ceramic heater element 150 and the other two connectors 340, 344 are the other of the live and neutral connectors.

Figure 11A:
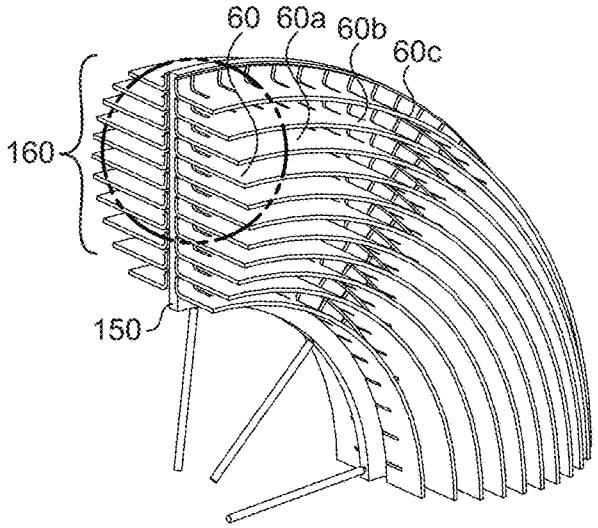
FIG. 11*a* shows an isometric view of an arcuate brazed heater.
Figure 11B:
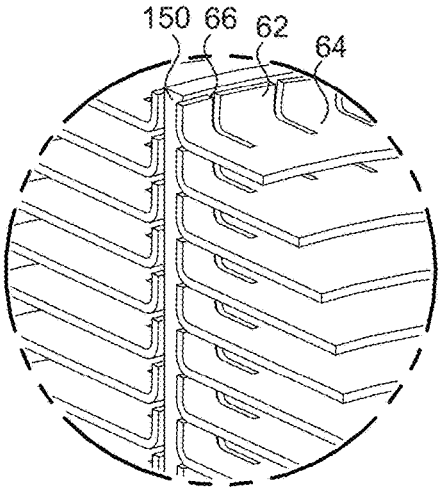
FIG. 11*b* shows an expanded view of a portion of the view of FIG. 11*a;*

FIGS. 11*a* and 11*b* show a brazed heater with fins of varying height 60, 60*a*, 60*b*, 60*c* and 60*d* as described with respect to FIGS. 8*a* and 8*b* but brazed onto an arcuate ceramic heater element 150.

FIG. 13*a* shows a brazed heater with fins 60 having varying spacing. The arcuate ceramic heater element 150 has an inner radius ri and an outer radius ro each having a common centre c. At the inner radius ri there is a fin spacing of xi and at the outer radius ro there is a fin spacing of xo where xo is greater than xi thus the spacing between the fins gradually increase from the inner radius ri towards the outer radius ro. The variable spacing helps with thermal and flow management as fluid in the heater flows from the first end 322 to the second end 324. The flow restriction in each channel (space between fins) is changed. This is a design variable which allows flow to be redistributed. The outer radius of the heater has a longer channel length (longer fins). A given volume of air will spend more time these channels, heating up more as it through the channel. If the spacing between fins is increased in this area, the flow rate in these channels will increase. This reduces the dwell time, so there is less heating of the air. In this example the inner radius was around 29 mm and the outer radius around 59 mm. The centre path length, this being the mid line between the inner radius and the outer radius is 69 mm. The height of a fin 60 is around 13 mm.

FIG. 13*b* illustrates that the fins 60 do not need necessarily to be aligned at the first end 322. Depending on the configuration of the inlet side 350 of the heater, it may not be possible to have the discrete connecting portions 62 starting at a common distance from this inlet side 350, thus a first fin 600 may be staggered with respect to an adjacent fin 602, 604.

Figure 14A:
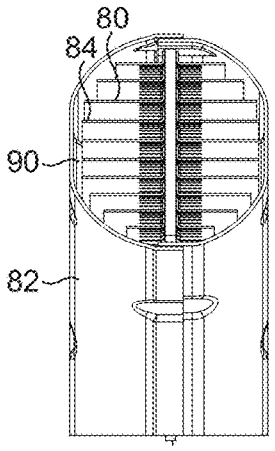
FIG. 14*a* shows an end view of a heater in an enclosure.
Figure 14B:
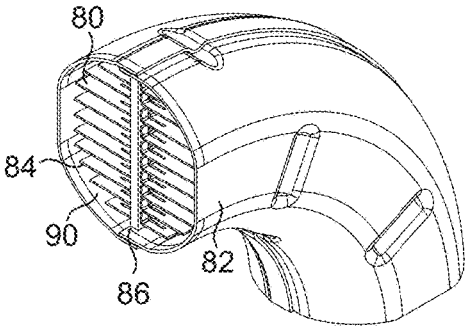
FIG. 14*b* shows an isometric view of a heater in an enclosure.

Referring now to FIGS. 14*a* and 14*b*, a heater 80 is shown in an enclosure 82. Traditionally such an enclosure would be made from an insulating material, such as mica. For the straight heater examples herein described mica would be acceptable. However, for the arcuate heaters, it is difficult to wind the mica sheets especially at the centre on the inner radius as the length on mica that would be required is less than on the outer radius. Due to this and the fact that the heat dissipating fins are not live, a metal enclosure can be used. With a more traditional wire heater this would not be possible as there would be a risk of the live heater element contacting the enclosure, perhaps after some damage is sustained. In theory, the enclosure 82 can be designed to contact the heater 80 however, it was found that having a small gap 90 between a fin tip 84 and both the first edge 86 and the second edge 86 of the ceramic heater element 150 is useful. A gap 90 of 0.5 mm to 2 mm was used as this gave a sufficient air gap to allow control of the flow around the curve and thermal management of the temperature of the enclosure. Thus, the outer surface of the enclosure 82 was 75° C. at an ambient temperature of 25° C.

Figure 15A:
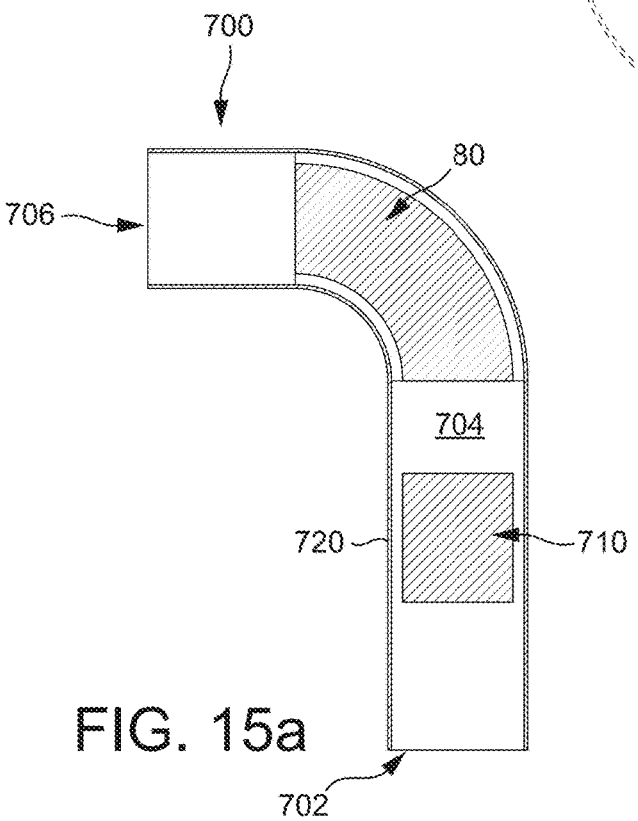
FIG. 15*a* shows a cross-section through an appliance suitable for accommodating a heater according to some embodiments.
Figure 15B:
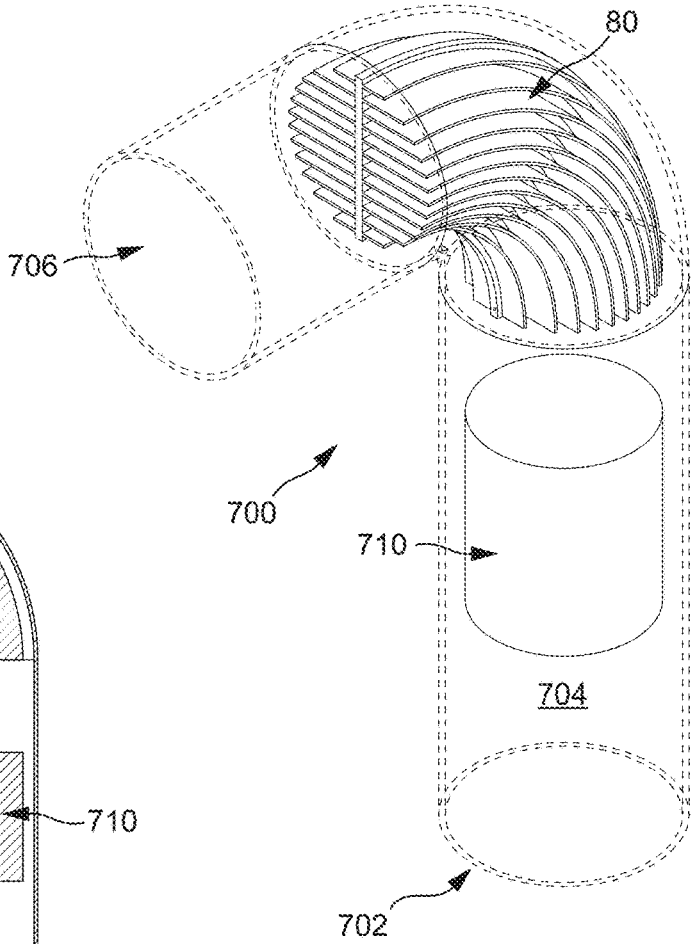
FIG. 15*b* shows a partial isometric view of an appliance suitable for accommodating a heater according to some embodiments.

FIGS. 15*a* and 15*b* show an example of a hairdryer in which the heater described can be used. The hairdryer 700 has a fluid inlet 702 at one end of a handle 720, a fluid flow path 704 extending from the fluid inlet 702 through the handle 720 to a fluid outlet 706. Fluid is drawn into the fluid inlet 702 by a motor 710 located within the handle 720. In this example, the heater 80 is curved or arcuate and resides in a transition region from a first orientation of the handle 720 to a second orientation of the fluid outlet 706. In this example the second orientation is orthogonal to the first orientation, but that is a preferred feature as when a user holds the handle the fluid outlet can be easily turned with respect to the users' hair.

The ceramic heater element herein described is designed to withstand 400° C. with a power input of 1500 W at a maximum fluid temperature at the outlet of 125° C. Table 4 shows a range of parameters that were achieved.

TABLE 4

| Flow rate | Max. exit temp | Track 1 temp | Track 2 temp | Power | Heater_P |
|---|---|---|---|---|---|
| 9 std l = s | 76° C. | 106° C. | 124° C. | 514 W | 469 Pa |
| | 101° C. | 161° C. | 186° C. | 766 W | 506 Pa |
| | 124° C. | 213° C. | 244° C. | 1003 W | 541 Pa |
| 11 std l = s | 76° C. | 110° C. | 130° C. | 584 W | 617 Pa |
| | 101° C. | 170° C. | 198° C. | 895 W | 689 Pa |
| | 125° C. | 229° C. | 264° C. | 1197 W | 734 Pa |
| 13.5 std l = s | 75° C. | 112° C. | 132° C. | 663 W | 875 Pa |
| | 101° C. | 178° C. | 208° C. | 1038 W | 947 Pa |
| | 129° C. | 260° C. | 301° C. | 1504 W | 1050 Pa |

Within the hairdryer shown in FIGS. 15*a* and 15*b*, the envelope for the heater 80 and enclosure 82—the heater assembly—has a maximum outer diameter of 35 mm. This heater 80 has been demonstrated to provide a heating element power of 1500 W at 13.5 l/s air flow through the hairdryer with a maximum heater assembly pressure drop of 1000 Pa at 13.5 l/s air and 1500 W input power. In addition with the varying fin spacing shown in FIG. 13*a* a maximum temperature difference of ±5 deg C. across the exiting air flow cross section.

Figure 9A:
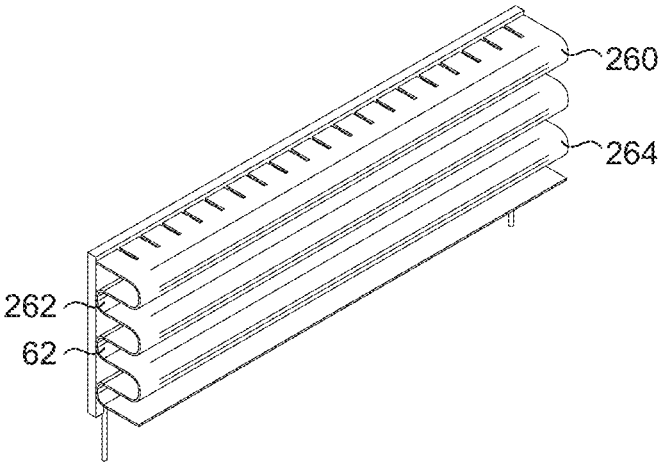
FIG. 9*a* shows an isometric view of a set of folded fins brazed to a ceramic heater element.
Figure 9B:
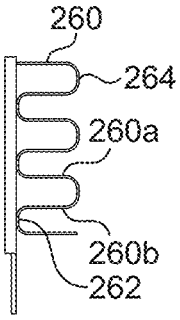
FIG. 9*b* shows a side view of a set of folded fins brazed to a ceramic heater element.
Figure 10A:
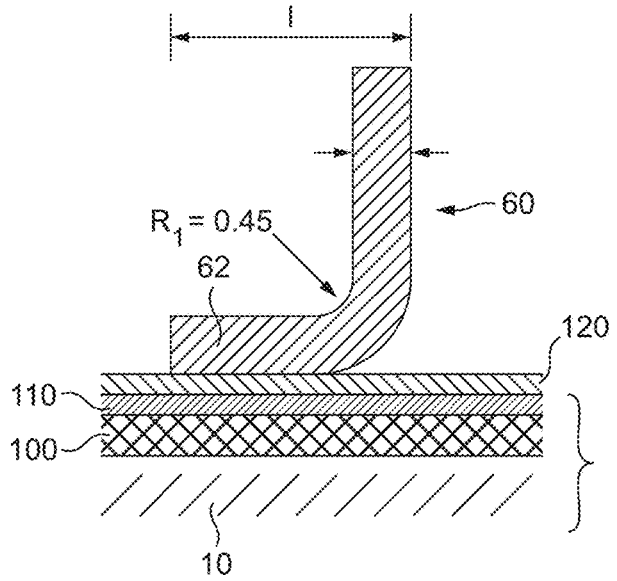
FIG. 10*a* shows a cross-section through a brazed fin.
Figure 10B:
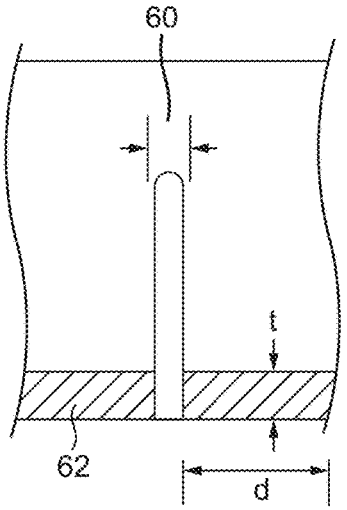
FIG. 10*b* shows a side view through a brazed fin.

FIGS. 9*a* and 9*b* show an alternative embodiment where the fins 260 are not formed as separate stamped sheets instead a single sheet of metal is folded into a corrugated or castellated form with a base portion 262 which is adapted to be brazed to the ceramic heater element 62. The process of forming the discrete connecting areas 264 is carried out after the stamping process but in the same manner as before. However, each fin 260 shares a discrete connecting area 264 rather than having an individual one. This further minimises the contact area and so regions of thermal mismatch between the metal fin and the ceramic heater element. In addition, there is a top section 264 which is fed heat via two adjacent fins 260*a*, 260*b* so the thermal delivery towards the fin tip is increased.

Figure 16:
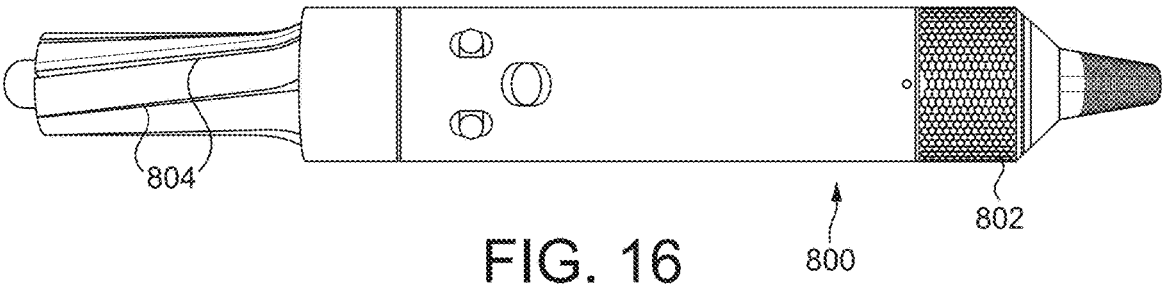
FIG. 16 shows a side view of an alternative appliance suitable for accommodating a heater according to some embodiments.

FIG. 16 shows a further example of a hot styling device 800 that is suitable for use with the straight heater as shown in FIG. 7*b*. The device is tubular in shape, has a fluid inlet 802 at one end and a fluid outlet 804 at the distal end with a fluid flow path in between. In use, a fan unit draws fluid into the fluid inlet and a heater optionally heats the fluid before it exits the device at the fluid outlet.

The invention has been described in detail with respect to a hairdryer and a hot styling device however, it is applicable to any appliance that draws in a fluid and directs the outflow of that fluid from the appliance.

The appliance can be used with or without a heater; the action of the outflow of fluid at high velocity has a drying effect.

The fluid that flows through the appliance is generally air, but may be a different combination of gases or gas and can include additives to improve performance of the appliance or the impact the appliance has on an object the output is directed at for example, hair and the styling of that hair.

The invention is not limited to the detailed description given above. Variations will be apparent to the person skilled in the art.

The invention claimed is:

1. A heater comprising a ceramic heater element that comprises a ceramic substrate and at least two fins for dissipating heat from the ceramic heater element, wherein the ceramic substrate extends along a plane in one dimension and the at least two fins extend away from the plane, and wherein each fin of the at least two fins is connected to the ceramic substrate along a length of the fin via discrete connecting portions of the fin such that the fin is not connected to the ceramic substrate along an entire length of the fin, wherein the discrete connecting portions are a plurality of uniform areas of contact between the ceramic substrate and the at least two fins.

2. The heater of claim 1, wherein the discrete connecting portions are each separated by a gap.

3. The heater of claim 2, wherein the fin has a thickness and the gap is between 0.8 and 1.2 times the fin thickness.

4. The heater of claim 1, wherein the at least two fins are disposed on each side of the ceramic heater element.

5. The heater of claim 1, wherein the heater comprises a plurality of fins extending from both sides of the ceramic heater element.

6. The heater of claim 5, wherein the plurality of fins vary in height from a first edge to a second edge of the plurality of fins.

7. A method of attaching a metal fin to a ceramic heater element, the method comprising:

(a) applying a filler material to a ceramic surface of the ceramic heater element;

(b) positioning a metal fin over the filler material to produce a heater template; and (c) brazing the heater template in a furnace at a temperature of between 750° C. and 900° C. to melt the filler and cause the filler and the ceramic surface of the ceramic heater element to react together.

8. The method of claim 7, wherein the fin is made from one of copper, stainless steel, and kovar.

9. The method of claim 7, further comprising:

(i) coating the ceramic surface of the ceramic heater element with a metallisation paste;

(ii) sintering the coated ceramic heater element;

(iii) electroless plating of a nickel layer on the sintered coated ceramic heater element to produce a primary metallised surface; and (iv) applying a flux to the primary metallised surface, wherein steps (i) to (iv) are carried out prior to step (a) and wherein step (c) additionally melts the flux located between the metal fin and the primary metallised surface and is carried out at a temperature of around 600° C.

10. The method of claim 9, wherein the metallisation paste is a mixture of the ceramic material used to form the ceramic heater element and a refractory material.

11. The method of claim 10, wherein the metallisation paste is applied to the ceramic heater element at a thickness of 10 to 12 microns.

* * * * *